US009466282B2

(12) United States Patent
Park et al.

(10) Patent No.: US 9,466,282 B2
(45) Date of Patent: Oct. 11, 2016

(54) VARIABLE RATE ADAPTIVE ACTIVE NOISE CANCELLATION

(71) Applicant: QUALCOMM Incorporated, San Diego, CA (US)

(72) Inventors: Hyun Jin Park, San Diego, CA (US); Deepak Kumar Challa, San Diego, CA (US); Catalin Lacatus, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 25 days.

(21) Appl. No.: 14/714,839

(22) Filed: May 18, 2015

(65) Prior Publication Data

US 2016/0125866 A1 May 5, 2016

Related U.S. Application Data

(60) Provisional application No. 62/073,563, filed on Oct. 31, 2014.

(51) Int. Cl.

| | |
|---|---|
| ***G10K 11/16*** | (2006.01) |
| ***G10K 11/175*** | (2006.01) |
| ***G10K 11/178*** | (2006.01) |

(52) U.S. Cl.

CPC ..... *G10K 11/175* (2013.01); *G10K 11/178* (2013.01); *G10K 2210/1081* (2013.01); *G10K 2210/3051* (2013.01); *G10K 2210/3053* (2013.01); *G10K 2210/30391* (2013.01)

(58) Field of Classification Search

None

See application file for complete search history.

(56) References Cited

U.S. PATENT DOCUMENTS

| | | | | |
|---|---|---|---|---|
| 5,506,627 | A * | 4/1996 | Ciardi | H03L 7/14 331/20 |
| 5,668,747 | A | 9/1997 | Ohashi | |
| 2002/0154620 | A1* | 10/2002 | Azenkot | H04L 5/026 370/347 |
| 2007/0076896 | A1 | 4/2007 | Hosaka et al. | |
| 2009/0012786 | A1 | 1/2009 | Zhang et al. | |
| 2010/0098265 | A1 | 4/2010 | Pan et al. | |
| 2010/0145171 | A1* | 6/2010 | Park | A61B 5/1455 600/324 |

(Continued)

FOREIGN PATENT DOCUMENTS

| | | | |
|---|---|---|---|
| JP | H07325588 | A | 12/1995 |
| WO | 2015191691 | A1 | 12/2015 |

OTHER PUBLICATIONS

International Search Report and Written Opinion for International Application No. PCT/US2015/053679, ISA/EPO, Date of Mailing Jan. 18, 2016,12 pages.

*Primary Examiner* — Muhammad N Edun

(74) *Attorney, Agent, or Firm* — Toler Law Group, PC

(57) ABSTRACT

A method of audio signal processing includes determining a difference between a first set of filter parameters of a first input frame of an active noise cancellation (ANC) filter and a second set of filter parameters of a second input frame of the ANC filter. The method further includes selectively modifying a duty cycle of adaptive ANC processing associated with the ANC filter based on the difference between the first set of filter parameters and the second set of filter parameters.

30 Claims, 7 Drawing Sheets

(56) References Cited

U.S. PATENT DOCUMENTS

| | | | |
|---|---|---|---|
| 2011/0007907 | A1 | 1/2011 | Park et al. |
| 2011/0099007 | A1 | 4/2011 | Zhang |
| 2012/0057722 | A1 | 3/2012 | Osako et al. |
| 2012/0140917 | A1 | 6/2012 | Nicholson et al. |
| 2012/0140943 | A1 | 6/2012 | Hendrix et al. |
| 2012/0203549 | A1 | 8/2012 | Naito |
| 2014/0072134 | A1 | 3/2014 | Po et al. |
| 2014/0233750 | A1 | 8/2014 | Park et al. |

* cited by examiner

VARIABLE RATE ADAPTIVE ACTIVE NOISE CANCELLATION

I. CROSS-REFERENCE TO RELATED APPLICATIONS

This application claims the benefit of and priority to U.S. Provisional Application No. 62/073,563, filed Oct. 31, 2014, the contents of which are incorporated herein by reference in their entirety.

II. FIELD

The present disclosure is generally related to audio signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Wireless telephones may utilize active noise cancellation (ANC) technology to actively reduce acoustic noise by generating a waveform that is an inverse form of the noise wave (e.g., having the same level and an inverted phase), also referred to as an anti-noise wave form. An ANC system generally uses one or more microphones to detect a noise reference signal, generates an anti-noise waveform based on the noise reference signal, and reproduces the anti-noise waveform through one or more speakers. The anti-noise waveform interferes destructively with the noise wave to reduce a level of noise that reaches a user located within a range of the speaker.

An acoustic noise cancellation (ANC) apparatus may include a microphone (a "reference microphone") to capture a reference acoustic noise signal from the environment and another microphone (an "error microphone") to capture an acoustic error signal. The ANC apparatus may include an ANC filter that uses a reference signal from the reference microphone to estimate the noise and to produce an anti-noise signal. The anti-noise signal has an amplitude that is matched to an amplitude of the reference signal, and the anti-noise signal has a phase that is opposite to a phase of the reference signal. In a feedback arrangement, the error signal captured by the error microphone may be used to adjust the anti-noise signal.

Active noise cancellation techniques may be applied to personal computing devices (e.g., cellular telephones) as well as to sound reproduction devices (e.g., headphones) to reduce acoustic noise from a surrounding environment. In such applications, the use of an ANC technique may reduce a level of background noise that reaches the ear (e.g., by up to twenty decibels) while delivering useful sound signals, such as music or voices. In headphones for communications applications, for example, the equipment typically has a microphone and a speaker. The microphone is used to capture the user's voice for transmission, and the speaker is used to reproduce the received signal.

IV. SUMMARY

The present disclosure is directed to systems and methods to vary a rate of adaptive active noise cancellation (ANC) processing based on a rate of acoustic change in a surrounding environment. In some cases, an adaptive algorithm may process a subset of input audio frames, rather than each input frame. Performing adaptive ANC processing on a reduced number of input frames (i.e., a subset of input frames) may result in reduced power consumption and improved battery life of a device (e.g., a wireless telephone).

In an adaptive ANC processing system, a processor may utilize an adaptive algorithm to adjust filter parameters associated with an ANC filter. An input reference signal may be provided to the processor based on audio that is captured by a reference microphone. Audio that is captured over a particular period of time (e.g., twenty milliseconds) may be provided to the processor as input frames of audio data. In some cases, the adaptive ANC processing system may process each input frame of audio data (e.g., at a constant rate). While processing each input frame may allow for fast adaptation, significant acoustic changes may occur relatively infrequently in some cases. In cases where significant acoustic changes occur infrequently, performing adaptive ANC processing at a constant rate (i.e., on each input frame) may consume processing resources in order to calculate relatively minor adjustments to the filter parameters. In the present disclosure, a rate of adaptive ANC processing is modified based on a difference between sets of filter parameters. Rather than performing adaptive ANC processing on each input frame, processing resources may be conserved by performing adaptive ANC processing on a subset of input frames (i.e., not all input frames).

To illustrate, a first set of filter parameters of a first input frame of an ANC filter and a second set of filter parameters of a second input frame of the ANC filter may be calculated. The calculated sets of filter parameters may be compared to determine a difference between the first set of filter parameters and the second set of filter parameters (e.g., a magnitude difference between filter responses, a phase difference between filter responses, a rate of change of filter parameters over a particular period of time, etc.). The difference may be used to control a duty cycle (e.g., a number of input frames to process or discard) of adaptive ANC processing. When the duty cycle is set to discard at least one input frame rather than perform adaptive ANC processing on each input frame, a counter may be used to determine whether a particular subsequent input frame is to be discarded or processed. As an illustrative, non-limiting example, when the duty cycle is set to discard 90% of the input frames (or to process 10% of the input frames), when the counter indicates that nine prior input frames have been discarded, a tenth input frame may be processed. In this example, a power consumption rate associated with a processor performing the adaptive ANC processing may be reduced by ninety percent relative to a power consumption rate associated with the processor performing the adaptive ANC processing on each input frame (i.e., discarding no input frames).

In some cases, multiple duty cycles (e.g., frame drop rates) may be utilized to allow for multiple adaptation rates. Each duty cycle may be associated with a particular threshold. To illustrate, when the difference provides an indication of a relatively moderate rate of acoustic change, the duty cycle of adaptive ANC processing may be set to discard a subset of the input frames. As an illustrative example, the duty cycle may be set such that 50% of the input frames are to be discarded (in order to allow for a moderate rate of adaptation). In this example, a power consumption rate associated with a processor performing the adaptive ANC processing may be reduced by fifty percent relative to a power consumption rate associated with the processor performing the adaptive ANC processing on each input frame (i.e., discarding no input frames). As another example, when the difference provides an indication of a relatively large rate of acoustic change, the duty cycle of adaptive ANC processing may be set such that each input frame is processed (in order to allow for fast adaptation).

In a particular aspect, a method of audio signal processing includes determining a difference between a first set of filter parameters of a first input frame (as compared to a second set of filter parameters of a second input frame) of an active noise cancellation (ANC) filter. The method also includes selectively modifying a duty cycle of adaptive ANC processing associated with the ANC filter based on the difference between the first set of filter parameters and the second set of filter parameters. For example, in some implementations, the duty cycle may be modified such that a processor performs adaptive ANC processing on a first subset of input frames of a plurality of input frames but refrains from performing adaptive ANC processing on a second subset of input frames of the plurality of input frames. The processor performs adaptive ANC processing on the first subset of input frames and may send (updated) filter parameter information to adjust the filter parameters of the ANC filter. The processor may refrain from sending filter parameter information to the ANC filter for a second subset of input frames.

In another aspect, an apparatus includes a processor and a memory coupled to the processor. The memory stores instructions that are executable by the processor to perform various operations. The operations may include determining a difference between a first set of filter parameters of a first input frame (that includes first audio data) of an ANC filter and a second set of filter parameters of a second input frame (that includes second audio data) of the ANC filter. The operations may further include selectively modifying a duty cycle of adaptive ANC processing associated with the ANC filter based on the difference between the first set of filter parameters and the second set of filter parameters.

In a further aspect, a non-transitory computer-readable medium includes instructions that are executable by a processor. The instructions, when executed by the processor, cause the processor to determine a difference between a first set of filter parameters of a first input frame (that includes first audio data) of an ANC filter and a second set of filter parameters of a second input frame (that includes second audio data) of the ANC filter. The instructions further cause the processor to selectively modify a duty cycle of adaptive ANC processing associated with the ANC filter based on the difference between the first set of filter parameters and the second set of filter parameters.

In another aspect, an apparatus includes means for determining a difference between a first set of filter parameters of a first input frame (that includes first audio data) of an ANC filter with respect to a second set of filter parameters of a second input frame (that includes second audio data) of the ANC filter. The apparatus further includes means for selectively modifying a duty cycle of adaptive ANC processing associated with the ANC filter based on the difference between the first set of filter parameters and the second set of filter parameters.

In a further aspect, an apparatus includes an ANC filter configured to perform active noise cancellation and a processor communicatively coupled to the ANC filter. The processor is configured to determine a duty cycle of adaptive ANC processing associated with the ANC filter. When the duty cycle of adaptive ANC processing has a first value, the processor consumes power at a first power consumption rate. When the duty cycle of adaptive ANC processing has a second value, the processor consumes power at second power consumption rate.

In another aspect, a method of audio signal processing is disclosed. The method includes operating in a first mode in response to determining that a difference between a first set of filter parameters of a first input frame of an ANC filter and a second set of filter parameters of a second input frame of the ANC filter satisfies a threshold. Operating in the first mode includes providing a subset of input frames of the ANC filter to a processor for performing adaptive ANC processing. The method includes operating in a second mode in response to determining that the difference between the first set of filter parameters and the second set of filter parameters does not satisfy the threshold.

One advantage associated with performing adaptive ANC processing on a subset of input frames (rather than each input frame) is a reduction in power consumption and improved battery life. Another advantage may include a reduction in memory resources associated with storing input frames for adaptive ANC processing.

Other aspects, advantages, and features of the present disclosure will become apparent after a review of the entire application, including the following sections: Brief Description of the Drawings, Detailed Description, and the Claims.

V. BRIEF DESCRIPTION OF THE DRAWINGS

FIG. 1 is a diagram of a particular implementation of a variable rate adaptive active noise cancellation (ANC) system;

FIG. 2 includes several diagrams to illustrate an example of varying a rate of adaptive ANC processing based on a difference of filter parameters over a particular period of time;

VI. DETAILED DESCRIPTION

Particular implementations of the present disclosure are described below with reference to the drawings. In the description, common features are designated by common reference numbers throughout the drawings.

Figure 1:
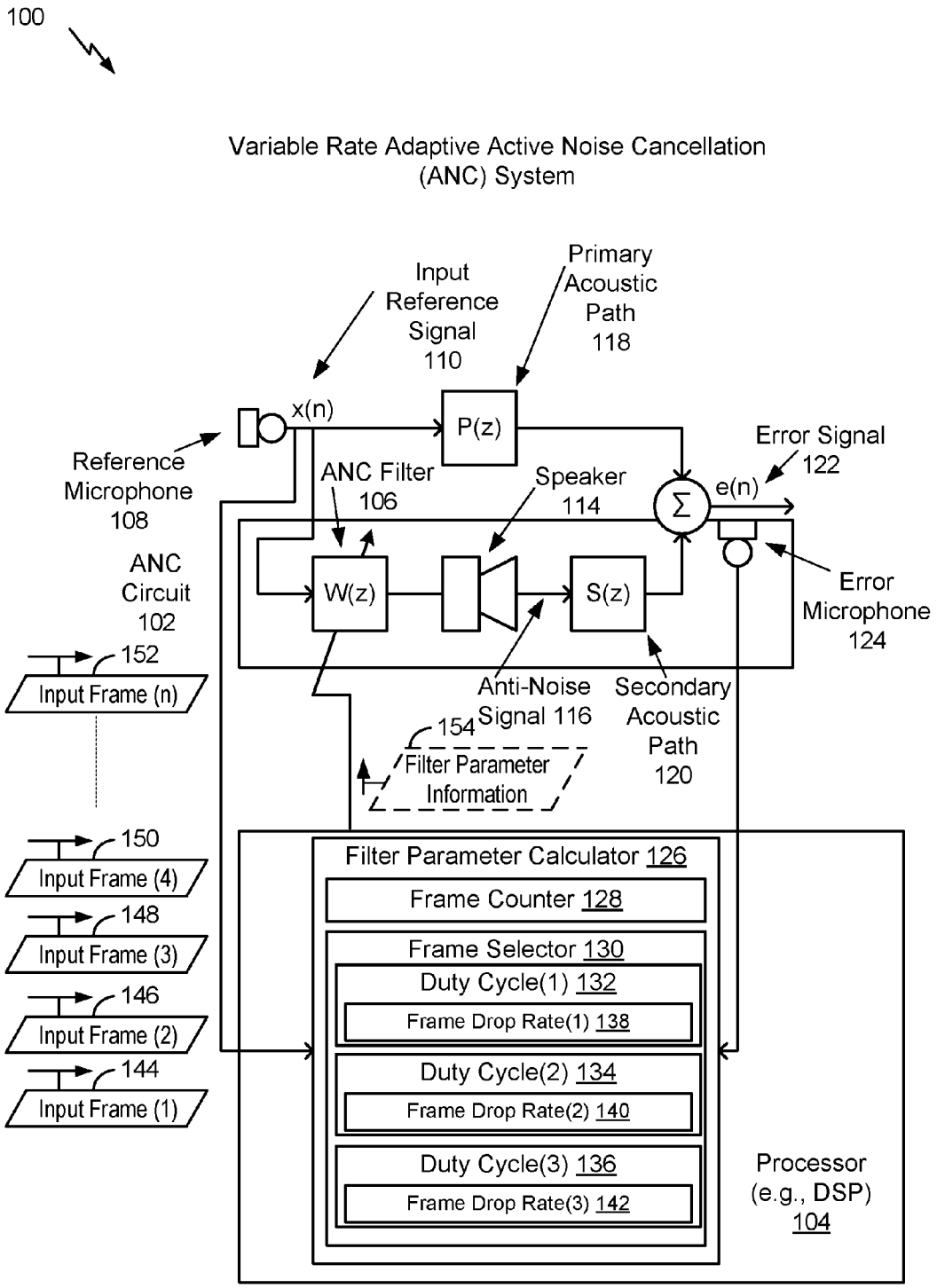

Referring to FIG. 1, a particular implementation of a variable rate adaptive active noise cancellation (ANC) system 100 is illustrated. In the example of FIG. 1, the system 100 includes an ANC circuit 102 communicatively coupled to a processor 104, such as a digital signal processor (or DSP). While FIG. 1 illustrates one example in which the ANC circuit 102 is separate from the processor 104 (e.g., the ANC circuit 102 is part of an audio CODEC), in other cases the ANC circuit 102 may be included within the processor 104. In the system 100 of FIG. 1, a duty cycle (e.g., a number of input frames to discard) of adaptive ANC processing associated with an ANC filter 106 of the ANC circuit 102 may be adjusted based on a difference of filter parameters between input frames. Rather than performing adaptive ANC processing on each input frame to calculate filter parameters to be provided to the ANC filter 106, a particular number of input frames may be discarded at the processor 104 based on the difference of filter parameters. Performing adaptive ANC processing on a subset of input frames (rather than all input frames) may result in a reduction of a power consumption rate at the processor 104 and may result in a reduction of memory resources associated with storing input frames for adaptive ANC processing.

In the particular implementation illustrated in FIG. 1, a reference microphone 108 is configured to capture audio data. The reference microphone 108 is communicatively coupled to the ANC circuit 102 and to the processor 104. The audio data that is captured by the reference microphone 108 may be communicated as an input reference signal 110 to the ANC filter 106 of the ANC circuit 102 and to the processor 104. The ANC filter 106 is configured to perform one or more active noise cancellation operations based on one or more filter parameters. As an illustrative example, the filter parameters may correspond to filter coefficients of a least-mean-squares (LMS) algorithm. The ANC filter 106 is communicatively coupled to a speaker 114 that may generate an anti-noise signal 116 based on an output of the ANC filter 106. FIG. 1 illustrates that the input reference signal 110 may be communicated via a primary acoustic path 118, while the anti-noise signal 116 generated by the speaker 114 may be communicated via a secondary acoustic path 120. An error signal 122 may be captured by an error microphone 124 and communicated to the processor 104.

In the particular implementation illustrated in FIG. 1, the processor 104 includes a filter parameter calculator 126 that includes a counter 128 and a frame selector 130. In the illustrative example of FIG. 1, the frame selector 130 may operate according to a first duty cycle 132, a second duty cycle 134, or a third duty cycle 136. In other implementations, an alternative number of duty cycles may be utilized. The first duty cycle 132 indicates a first frame drop rate 138 (i.e., a first number of input frames to discard), the second duty cycle 134 indicates a second frame drop rate 140 (i.e., a second number of input frames to discard), and the third duty cycle 136 indicates a third frame drop rate 142 (i.e., a third number of frames to discard). In some implementations, the filter parameter calculator 126 is configured to determine whether to discard a particular input frame or to process the particular input frame based on the counter 128 and the particular duty cycle (e.g., the first duty cycle 132, the second duty cycle 134, or the third duty cycle 136). For illustrative purposes only, FIG. 1 illustrates that the reference microphone 108 may capture audio data to be provided as a first input frame 144 (that includes first audio data), a second input frame 146 (that includes second audio data), a third input frame 148 (that includes third audio data), a fourth input frame 150 (that includes fourth audio data) and subsequent input frames including an nth input frame 152 (that includes nth audio data).

The processor 104 may perform adaptive ANC processing by calculating filter parameters for the ANC filter 106 and providing the calculated filter parameters to the ANC filter 106. FIG. 1 illustrates that the processor 104 may communicate filter parameter information 154 (e.g., to adjust the filter parameters of the ANC filter 106). As described further herein, the processor 104 may refrain from communicating the filter parameter information 154 when particular input frame(s) are discarded (i.e., adaptive ANC processing is not performed). The adaptive ANC processing may include determining filter parameters (W) to be used by the ANC filter 106 in performing acoustic noise cancellation. In a particular implementation, a least-mean-squares (LMS) algorithm includes a plurality of filter coefficients, and the filter parameters (W) may correspond to the filter coefficients of the LMS algorithm. In this case, the adaptive ANC processing may include calculating updated filter coefficients of the LMS algorithm and providing the updated filter coefficients to the ANC filter 106 as the filter parameter information 154. In some implementations, the LMS algorithm may be a feed forward LMS (FxLMS) algorithm. As another example of determining a difference of filter parameters, a filter coefficient (or multiple filter coefficients) may be monitored over a particular time period in order to identify a location of a peak value of a filter coefficient (or multiple filter coefficients) within the particular time period. As a further example of determining a difference of filter parameters, one or more filter coefficients may be monitored over a particular time period in order to identify a number of filter coefficient values that satisfy a particular threshold over the particular time period.

In a particular implementation, the filter parameter calculator 126 may determine a difference (dW) between current filter coefficients and the updated filter coefficients. That is, dW may correspond to a difference between W(n) and W(n−1), where W(n−1) represents the current filter parameters (calculated based on a prior input frame) and W(n) represents updated filter parameters (calculated based on a current input frame). The magnitude of the difference between filter coefficients may be used as an indicator of a level of acoustic changes (e.g., small or large acoustic changes). In a particular illustrative example, the magnitude of the difference (|dW|) may be determined using an LMS algorithm that utilizes a learning factor ("alpha"), information associated with the input reference signal 110, and information associated with the error signal 122. The magnitude of change of filter parameters (e.g., |dW|) may be used to vary a rate (or duty cycle) of adaptive ANC processing.

As one example, a "standard" LMS algorithm may determine dW based on the following formula:

$$dW=-\text{alpha}*X*e$$

In this example, alpha represents a learning factor, X represents the input reference signal 110, and e represents the error signal 122. In alternative implementations, a slope of the error signal 122 may be monitored in order to change an adaptation rate.

As another example, a "normalized" LMS algorithm may determine dW based on the following formula:

$$dW=-\text{alpha}*X*e/E|X|/E|e|$$

In this example, alpha represents a learning factor, X represents the input reference signal 110, e represents the error signal 122, E|X| represents an average amplitude of the input reference signal 110 over a particular time period, and E|e| represents an average amplitude of the error signal 122 over the particular time period.

In operation, the filter parameter calculator 126 may determine a magnitude of change of filter parameters (e.g., |dW|) of the ANC filter 106 between two input frames (an "LMS delta") based on the "standard" LMS algorithm or based on the "normalized" LMS algorithm, among other alternatives. As one example, dW may be calculated based on the input reference signal 110 for the second input frame 146 and the error signal 122 for the second input frame 146. The calculated dW may be added to the current filter parameters (W) that were previously calculated for a prior input frame (e.g., the first input frame 144 when operating according to the first duty cycle 132 where no input frames are dropped), resulting in the updated filter parameters (W') that may be provided to the ANC filter 106 as the filter parameter information 154. As another example, dW may be calculated based on the input reference signal 110 for the third input frame 148 and the error signal 122 for the third input frame 148. The calculated dW may be added to the current filter parameters (W) that were previously calculated for a prior input frame (e.g., the first input frame 144 when operating according to the second duty cycle 134 where every other input frame is dropped), resulting in the updated filter parameters (W') that may be provided to the ANC filter 106 as the filter parameter information 154. A rate of adaptive ANC processing that is performed at the processor 104 may be adjusted based on the magnitude of the change. Rather than performing adaptive ANC processing for each input frame when the magnitude of acoustic range is relatively small, a subset of input frames may be discarded rather than processed. Different rates (duty cycles) of adaptive ANC processing may correspond to different numbers of frames to discard. When the magnitude of the change is relatively high, the duty cycle may be set such that adaptive ANC processing is performed on each input frame. When the magnitude of change is moderate or relatively small, the duty cycle may be set such that a subset of input frames may be discarded.

In operation, the filter parameter calculator 126 may calculate filter parameters of the ANC filter 106 for an input frame, such as the first input frame 144. The filter parameter calculator 126 may subsequently calculate filter parameters of the ANC filter 106 for another input frame (e.g., the second input frame 146, the third input frame 148, the fourth input frame 150, or the nth input frame 152). As an illustrative, non-limiting example, the filter parameter calculator 126 may compare the filter parameters calculated for the second input frame 146 to the filter parameters calculated for the first input frame 144 (i.e., a previous input frame), and the magnitude of change of the filter parameters may be determined based on the comparison. The magnitude of the change of the filter parameters may be compared to one or more thresholds (e.g., thresholds associated with a relatively large level of acoustic change, a moderate level of acoustic change, a relatively small level of acoustic change, etc.). The filter parameter calculator 126 may set (or modify) the duty cycle of adaptive ANC processing based on a result of comparing the magnitude of change of the filter parameters to the one or more thresholds.

As an illustrative example, a first threshold may be associated with the first duty cycle 132. When the filter parameter calculator 126 determines that the magnitude of change of the filter parameters satisfies the first threshold, the first duty cycle 132 may be selected. When the first duty cycle 132 is selected, adaptive ANC processing may be performed on each input frame. That is, the first frame drop rate 138 may be zero, such that no input frames are discarded (and all input frames are processed). To illustrate, as described further herein with respect to FIG. 2, the first duty cycle 132 may correspond to the first duty cycle 202 and may include processing of 100% of input frames (e.g., at a rate of 50 Hz for 20 millisecond frames of audio data).

When the filter parameter calculator 126 determines that the magnitude of change of the filter parameters does not satisfy the first threshold, the second duty cycle 134 may be selected. The second duty cycle 134 may correspond to performing adaptive ANC processing on a first number of input frames and refraining from performing adaptive ANC processing on a second number of input frames. In this case, the second frame drop rate 140 may correspond to the second number of input frames. To illustrate, as described further herein with respect to FIG. 2, the second duty cycle 134 may correspond to the second duty cycle 204 and may include processing 50% of input frames (e.g., at a rate of 25 Hz for 20 millisecond frames of audio data).

In the example of FIG. 1, a second threshold may be associated with the second duty cycle 134. When the filter parameter calculator 126 determines that the magnitude of change of the filter parameters does not satisfy the second threshold, the third duty cycle 136 may be selected. The third duty cycle 136 may correspond to performing adaptive ANC processing on a third number of input frames and refraining from performing adaptive ANC processing on a fourth number of input frames. In this case, the third frame drop rate 142 may correspond to the third number of input frames. To illustrate, as described further herein with respect to FIG. 2, the third duty cycle 136 may correspond to the third duty cycle 206 and may include processing 10% of input frames (e.g., at a rate of 10 Hz for 20 millisecond frames of audio data).

FIG. 1 further illustrates that additional input frames are received, such as the third input frame 148, the fourth input frame 150, and the nth input frame 152. The frame selector 130 may determine whether a particular input frame (e.g., the third input frame 148, the fourth input frame 150, or the nth input frame 152) is to be discarded based on the frame counter 128 and based on the duty cycle. For example, when operating according to the first duty cycle 132 (where no frames are discarded), the third input frame 148 is processed after the second input frame 146. As another example, when operating according to the first duty cycle 132, the fourth input frame 150 is processed after the third input frame 148.

When operating according to the second duty cycle 134, the frame selector 130 determines whether to discard or process the particular input frame based on the second frame drop rate 140 and the frame counter 128. As an illustrative example, the second frame drop rate 140 may include discarding 50% of input frames (i.e., every other input frame). Accordingly, when operating according to the second duty cycle 134 and the third input frame 148 is received, the frame selector 130 may determine whether the frame counter 128 indicates that a prior input frame (i.e., the second input frame 146) was discarded. In this example, when the frame counter 128 indicates that the second input frame 146 was discarded (e.g., a frame count of one), adaptive ANC processing may be performed for the third input frame 148. When the frame counter 128 indicates that the second input frame 146 was not discarded (e.g., a frame count of zero), the third input frame 148 may be discarded.

When operating according to the third duty cycle 136, the frame selector 130 determines whether to discard or process the particular input frame based on the third frame drop rate 142 and the frame counter 128. For example, the third duty cycle 136 may include processing 10% of input frames (i.e., every tenth frame). When operating according to the third duty cycle 136 and after a subsequent input frame (e.g., the nth input frame 152) is received, the frame selector 130 may determine whether to discard or process the nth input frame 152 based on whether the nth input frame 152 represents the tenth input frame (i.e., whether the frame counter 128 indicates that nine prior input frames were discarded). In this example, when the frame counter 128 indicates that nine input frames prior to the nth input frame 152 were discarded (e.g., a frame count of nine), adaptive ANC processing may be performed for the nth input frame 152. When the frame counter 128 indicates that nine input frames prior to the nth input frame 152 were not discarded (e.g., a frame count of less than nine), the nth input frame 152 may be discarded.

In response to determining that a particular input frame is to be discarded, the frame selector 130 increments the frame counter 128. For subsequent input frames, the frame selector 130 may determine whether a particular input frame is to be discarded or processed based on a current duty cycle and the incremented frame counter 128. As an illustrative example, when operating according to the second duty cycle 134 (e.g., processing every other input frame), the frame selector 130 increments the frame counter 128 (e.g., from a frame count of zero to a frame count of one) after discarding the third input frame 148. In this case, when the fourth input frame 150 is received, the frame selector 130 may determine that the prior input frame (i.e., the third input frame 148) was discarded based on the frame counter 128 (e.g., the frame count of one). Accordingly, the frame selector 130 determines that adaptive ANC processing is to be performed for the fourth input frame 150. As another illustrative example, when operating according to the third duty cycle 136 (e.g., processing every tenth frame), the frame selector 130 increments the frame counter 128 after discarding the nth input frame 152. In this case, when a subsequent input frame (e.g., input frame n+1) is received, the frame selector 130 may determine whether to discard or process the particular input frame based on whether the particular input frame represents the tenth input frame (i.e., whether the frame counter 128 indicates that nine prior input frames were discarded). When the subsequent input frame is not the tenth input frame, the frame counter 128 may be incremented, and the frame selector 130 may continue to discard input frames until the frame counter 128 indicates that nine input frames have been discarded and a received input frame represents the tenth input frame.

In response to determining that adaptive ANC processing is to be performed for a particular input frame, the filter parameter calculator 126 may calculate the filter parameters of the ANC filter 106 for the particular input frame and may compare the filter parameters for the particular input frame to filter parameters calculated for a previous input frame (e.g., the first input frame 144, the second input frame 146, the third input frame 148, the fourth input frame 150, the nth input frame 152, or another input frame depending on the current duty cycle). The filter parameter calculator 126 may update the number of input frames to be discarded based on the magnitude of change of the filter parameters and may increment the frame counter 128. Further, as shown in the example of FIG. 1, after performing adaptive ANC processing on a particular input frame, the processor 104 may provide the (updated) filter parameter information 154 to the ANC filter 106.

Thus, FIG. 1 illustrates that a magnitude of change of filter parameters of the ANC filter 106 between two input frames may be used to set the duty cycle for adaptive ANC processing of subsequent input frames. In some cases, the duty cycle may correspond to a subset of input frames to be discarded (e.g., a particular number of input frames to discard after performing adaptive ANC processing on a particular input frame and providing the associated filter parameter information 154 to the ANC filter 106). Discarding some input frames rather than performing adaptive ANC processing on each input frame may result in a reduced power consumption rate (e.g., at the processor 104) and a reduction of memory resources associated with storing each input frame for adaptive ANC processing.

Figure 2:
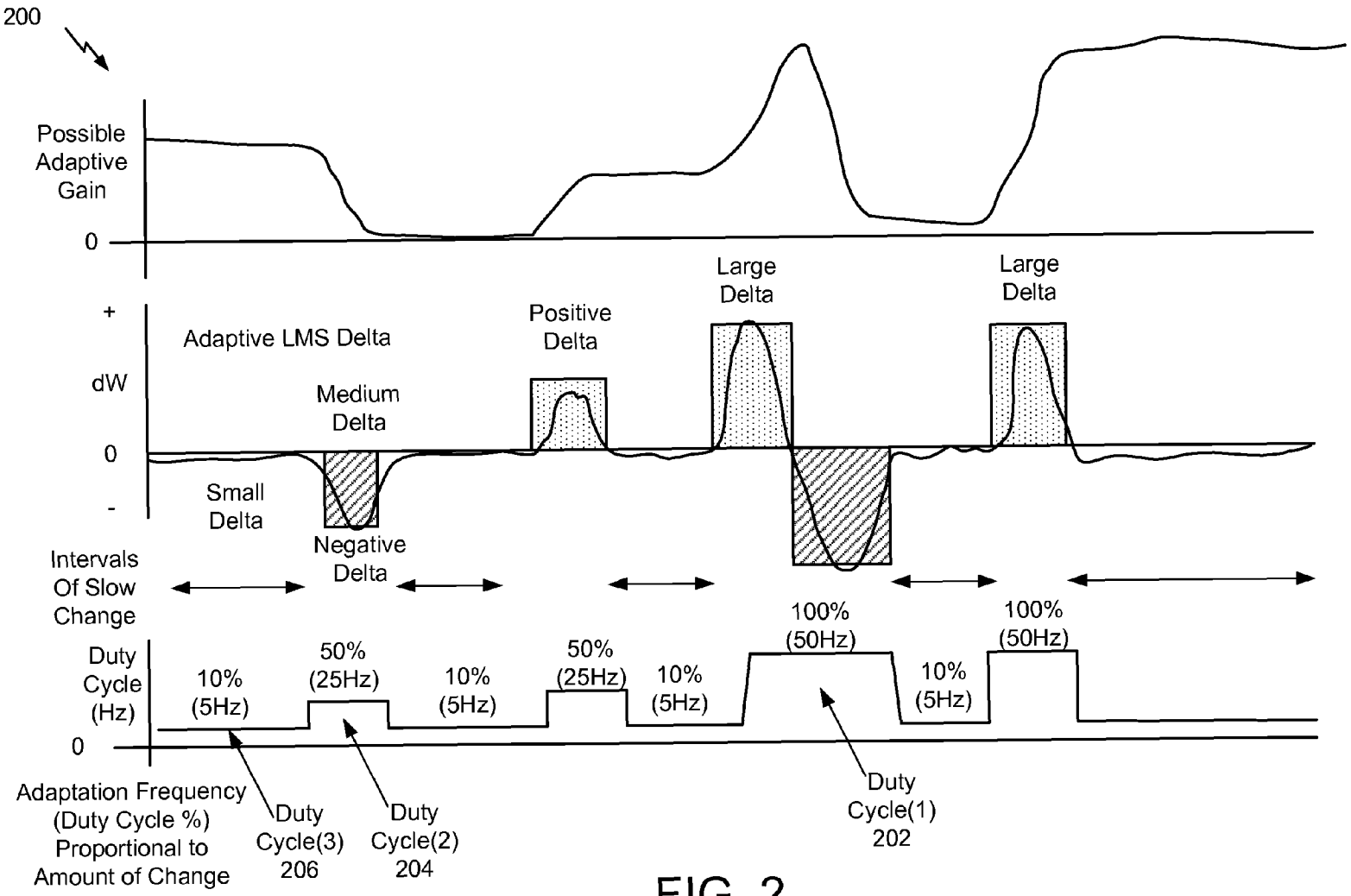

FIG. 2 includes several diagrams (generally designated 200) to illustrate an example of varying a rate of adaptation of an ANC system based on a magnitude of change of filter parameters over a particular period of time. FIG. 2 illustrates that the duty cycle may be adjusted according to a relative amount of acoustic change. In FIG. 2, the duty cycle may be set to discard more input frames during slow change intervals, while the duty cycle may be set to discard fewer input frames during medium change intervals, potentially resulting in a reduced power consumption rate. FIG. 2 further illustrates that during periods of large acoustic change, the duty cycle may be adjusted such that each input frame is processed, allowing for faster adaptation.

FIG. 2 illustrates a particular implementation in which the magnitude of change of filter parameters corresponds to a magnitude of LMS Delta (i.e., |dW|). A small LMS delta may be associated with slow change intervals, a medium LMS delta may be associated with medium change intervals, and a large LMS delta may be associated with large change intervals. In FIG. 2, a first duty cycle 202 may be associated with large change intervals, a second duty cycle 204 may be associated with medium change intervals, and a third duty cycle 206 may be associated with small change intervals.

In the example of FIG. 2, the first duty cycle 202 corresponds to performing adaptive ANC processing on 100% of input frames (e.g., processing 20 ms input frames of audio data at 50 Hz). The second duty cycle 204 corresponds to performing ANC processing on 50% of input frames (e.g., processing 20 ms input frames of audio data at 25 Hz). The third duty cycle 206 corresponds to performing ANC processing on 10% of input frames (e.g., processing 20 ms input frames of audio data at 5 Hz). FIG. 2 is for illustrative purposes only. In alternative implementations, an alternative number of duty cycles may be used. Further, alternative percentages of input frames to be discarded and/or processed may be used.

While FIG. 2 illustrates that acoustic changes may be detected based on a change of filter parameters, alternative methods of detecting acoustic changes may include determining a change of normalized and averaged error energy, sensing movements (e.g., of a headset device or a handset device) based on input from a motion sensor (e.g., an accelerometer), detecting a pressing pressure (e.g., on a touch screen), or detecting a touch area (e.g., on a touch screen), among other alternatives.

To illustrate, a delta on |E|/|N| (i.e., normalized averaged error energy) may be an indicator for ANC noise reduction performance. ANC noise reduction changes may be an indicator that faster adaptation is appropriate. A substantially constant ANC noise reduction may indicate that fast adaptation may be inappropriate. Accordingly, the delta of the normalized and averaged error energy can be used as one mechanism to detect acoustic changes. With respect to accelerometer sensors, sensors installed at an ANC device may be used to measure movement of a user's body or movement of a device. Accordingly, acceleration may be used as one measure to determine an adaptive ANC processing rate. With respect to pressure sensors, the pressing pressure between a user's skin and a device can provide information about changes of acoustic interface. Accordingly, the change of pressure may be used as a measure to determine an adaptive ANC processing rate. With respect to touch sensors, the user's skin touch area on a touchscreen display of an ANC device can provide information about changes of acoustic interface as well. Accordingly, the change in detected touch area may be used as a measure to determine an adaptive ANC processing rate.

Thus, FIG. 2 illustrates that a rate of adaptive ANC processing may be modified based on a rate of acoustic change. In cases where the rate of acoustic change represents a relatively "large" rate of acoustic change, the duty cycle may be set such that each input frame is processed in order to allow for fast adaptation. In cases where the rate of acoustic change represents a relatively "medium" rate of acoustic change, the duty cycle may be set to refrain from processing a particular number of input frames (e.g., 50% of input frames). In cases where the rate of acoustic change represents a relatively "small" rate of acoustic change, the duty cycle may be set to refrain from processing more input frames (e.g., refraining from processing 90% of input frames).

Figure 3:
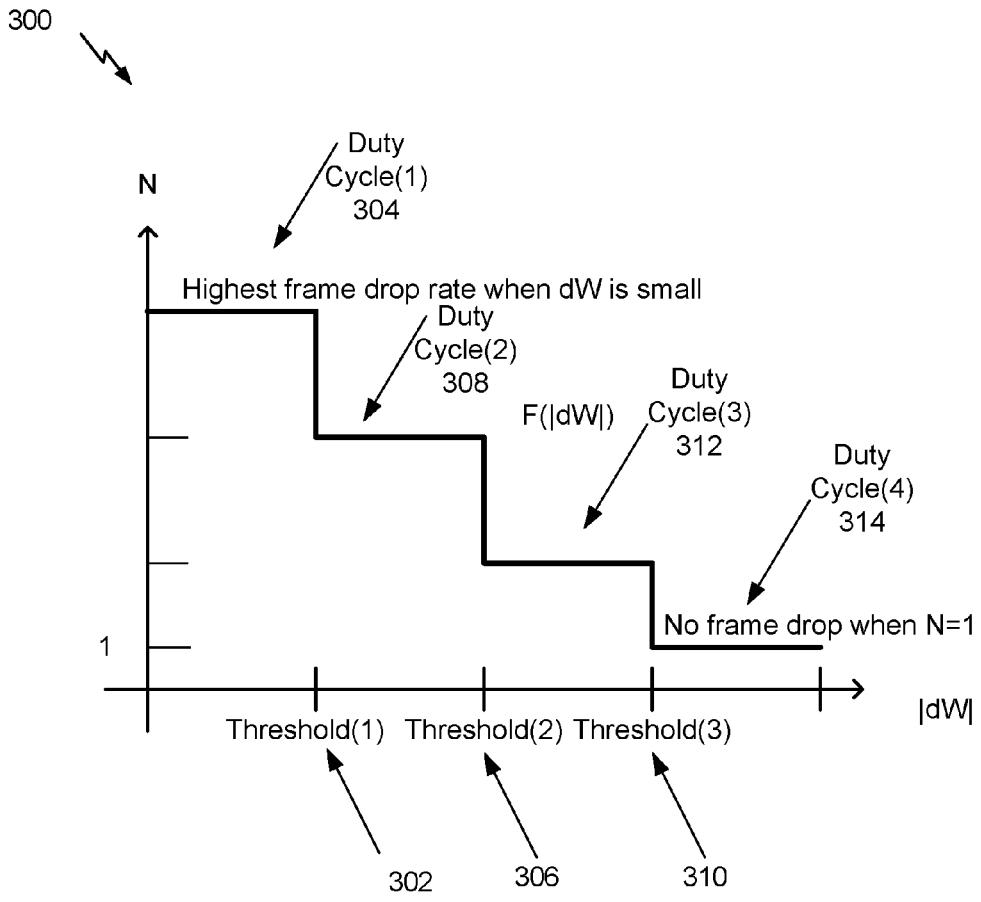
FIG. 3 is a diagram of a particular implementation of a mapping function that varies a rate of adaptive ANC processing by adjusting a frame drop rate based on a comparison of a difference of filter parameters to multiple thresholds.

FIG. 3 illustrates a particular example of a mapping function (F(|dW|) that varies a rate of adaptation of an ANC system by adjusting a frame drop rate based on a comparison of a magnitude of change of filter parameters to multiple thresholds. In FIG. 3, the highest frame drop rate (and associated processing resource reduction) may occur for relatively small changes of filter parameters (|dW|), while the lowest frame drop rate (i.e., a frame drop rate of zero, where each input frame is processed) occurs for relatively large changes of filter parameters.

In the example of FIG. 3, multiple thresholds are illustrated. In FIG. 3, when the magnitude of change (|dW|) is below a first threshold 302, a duty cycle of adaptive ANC processing may be set to a first duty cycle 304 corresponding to a first frame drop rate. That is, the highest frame drop rate may occur when |dW| is between zero and the first threshold 302. For example, referring to FIG. 2, the frame drop rate may correspond to the third duty cycle 206 where 9 out of 10 frames are dropped, while every 10th frame is processed. This may result in a power savings of 90% in terms of adaptive ANC processing power consumption compared to performing adaptive ANC processing on each input frame. Such a duty cycle may be appropriate in particular applications where there may be few abrupt acoustic changes.

When the magnitude of change (|dW|) is between the first threshold 302 and a second threshold 306, the duty cycle may be set to a second duty cycle 308 corresponding to a second frame drop rate. For example, referring to FIG. 2, the frame drop rate may correspond to the second duty cycle 204 where 5 out of 10 frames are dropped (i.e., every other frame is processed). This may result in a power savings of 50% in terms of adaptive ANC processing power consumption compared to performing adaptive ANC processing on each input frame. When the magnitude of change (|dW|) is between the second threshold 306 and a third threshold 310, the duty cycle may be set to a third duty cycle 312 corresponding to a third frame drop rate (e.g., more than 5 out of 10 frames are dropped). Compared to the example of the second duty cycle 204 of FIG. 2, this may result in a power savings of less than 50% in terms of adaptive ANC processing power consumption compared to performing adaptive ANC processing on each input frame.

FIG. 3 further illustrates a fourth duty cycle 314 in which no frames are dropped and each frame is processed when the magnitude of change (|dW|) exceeds the third threshold 310. For example, referring to FIG. 2, the frame drop rate may correspond to the first duty cycle 202 where no input frames are dropped and each input frame is processed. As an illustrative example, acoustics of a headset may change relatively rapidly when a user moves her head, presses the headset in her ear, or adjusts the headset to make the headset more tight or more loose. That is, acoustic changes may be associated with a mechanical speed that the user is moving the headset. A fast rate of acoustic change may be associated with the user moving the device quickly, and a fast rate of adaptation may be appropriate in order to follow such abrupt changes. By contrast, if the user is sitting in a chair, there may be relatively few abrupt acoustic changes.

In some cases, the duty cycles and/or the thresholds may be predetermined (e.g., based on empirical data for a particular device and/or a particular application). In other cases, the user may adjust the rate of adaptive ANC processing. For example, the user may desire to reduce power consumption and may set the device to a power saving mode with a higher frame drop rate. Alternatively, the user may desire to have a faster rate of adaptation and may set the device to a mode in which each input frame is processed. A user interface may allow the user to adjust the mode of operation.

Figure 4:
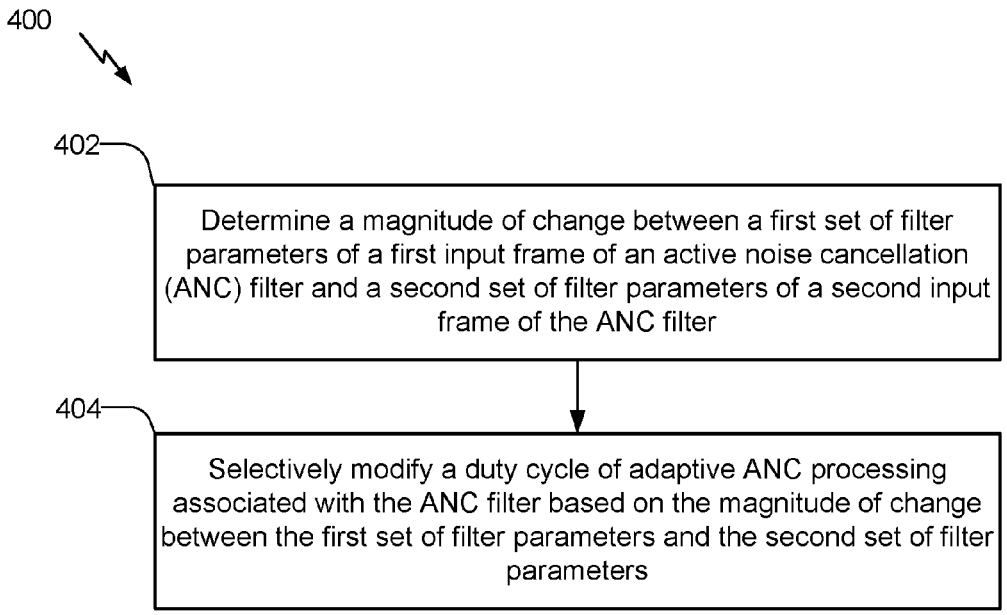
FIG. 4 is a flow diagram that illustrates a particular example of a method of varying a rate of adaptive ANC processing.

Referring to FIG. 4, a particular example of a method of operation is shown and generally designated 400. In FIG. 4, a magnitude of change between a first set of filter parameters of a first input frame of an ANC filter and a second set of filter parameters of a second input frame of the ANC filter may be used to determine a duty cycle of adaptive ANC processing. In some cases, the first input frame and the second input frame may be sequential (e.g., when a processor is operating according to a duty cycle in which adaptive ANC processing is performed for each input frame). In other cases, the first input frame and the second input frame may be non-sequential (e.g., when a processor is operating according to a duty cycle in which a subset of input frames is discarded). Thus, the duty cycle of adaptive ANC processing associated with an ANC filter may correspond to a subset of input frames to be discarded. Discarding some input frames rather than performing adaptive ANC processing on each input frame may result in a reduction of a power consumption rate (e.g., at a DSP) and a reduction of memory resources associated with storing each input frame for adaptive ANC processing.

The method 400 includes determining a magnitude of change between a first set of filter parameters of a first input frame of an ANC filter and a second set of filter parameters of a second input frame of the ANC filter, at 402. For example, referring to FIG. 1, the filter parameter calculator 126 may calculate filter parameters of the ANC filter 106 for the first input frame 144, and the filter parameter calculator 126 may calculate filter parameters of the ANC filter 106 for the second input frame 146. The filter parameter calculator 126 may compare the filter parameters for the first input frame 144 to the filter parameters for the second input frame 146 and may determine the magnitude of change of the filter parameters based on the comparison. For example, as described further herein with respect to FIG. 1, the magnitude of change (e.g., |dW|) of filter parameters of the ANC filter 106 may be determined based on the "standard" LMS algorithm or based on the "normalized" LMS algorithm, among other alternatives.

The method 400 also includes selectively modifying a duty cycle of adaptive ANC processing associated with the ANC filter based on the magnitude of change between the first set of filter parameters and the second set of filter parameters, at 404. For example, referring to FIG. 1, the filter parameter calculator 126 may set the duty cycle of adaptive ANC processing based on the magnitude of change of the filter parameters between the first input frame 144 and the second input frame 146. To illustrate, the duty cycle of adaptive ANC processing may be set to the first duty cycle 132, to the second duty cycle 134, or to the third duty cycle 136, based on the magnitude of change of the filter parameters.

As one example, when the filter parameter calculator 126 determines that the magnitude of change of the filter parameters satisfies a first threshold (corresponding to a relatively large acoustic change, as described further herein with respect to FIGS. 2 and 3), the duty cycle may be set to the first duty cycle 132 where the first frame drop rate 138 may correspond to zero. In this case, each input frame may be processed, allowing for fast adaptation. As another example, when the filter parameter calculator 126 determines that the magnitude of change of the filter parameters does not satisfy the first threshold (corresponding to a moderate level of acoustic change, as described further herein with respect to FIGS. 2 and 3), the duty cycle may be set to the second duty cycle 134. In this case, the filter parameter calculator 126 may perform adaptive ANC processing on a first number of input frames and may refrain from performing adaptive ANC processing on a second number of input frames (e.g., discarding every other input frame and processing every other input frame). As a further example, when the filter parameter calculator 126 determines that the magnitude of change of the filter parameters satisfies a second threshold (corresponding to a relatively small level of acoustic change, as described further herein with respect to FIGS. 2 and 3), the duty cycle may be set to the third duty cycle 136. In this case, the filter parameter calculator 126 may perform adaptive ANC processing on a third number of input frames and may refrain from performing adaptive ANC processing on a fourth number of input frames (e.g., discarding nine input frames and processing every tenth input frame).

Figure 5:
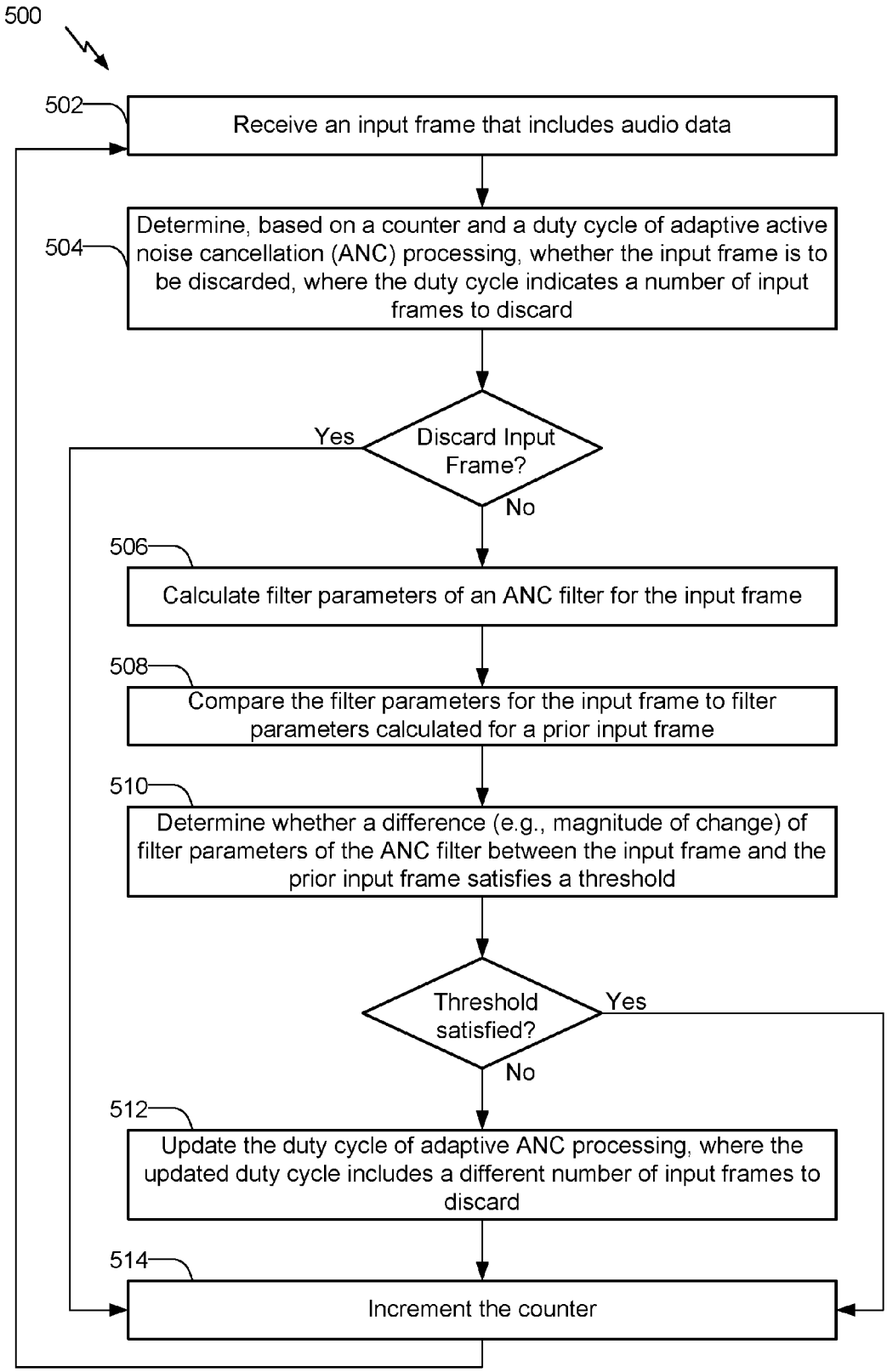
FIG. 5 is a flow diagram that illustrates another example of a method of varying a rate of adaptive ANC processing.

Referring to FIG. 5, a particular example of a method of operation is shown and generally designated 500. FIG. 5 illustrates a particular example of variable rate adaptive ANC processing that determines whether a particular input frame is to be discarded (e.g., based on a counter and a duty cycle). In the event that the input frame is to be processed, a magnitude of change of filter parameters between the input frame and a prior input frame may be used to determine whether to adjust the duty cycle.

The method 500 includes receiving an input frame that includes audio data, at 502. For example, referring to FIG. 1, an input frame (e.g., one of the input frames 144-152) may be received at the processor 104. The method 500 determines whether the input frame is to be discarded, at 504. The determination of whether to discard the input frame is based on a counter and a duty cycle of adaptive ANC processing, where the duty cycle indicates a number of input frames to discard. For example, referring to FIG. 1, the frame selector 130 may determine whether to discard a particular input frame based on the frame counter 128 and a particular duty cycle of ANC processing. As one example, when performing adaptive ANC processing based on the first duty cycle 132, the frame selector 130 may determine whether to discard the particular input frame based on the frame counter 128 and based on the first frame drop rate 138. As described further herein with respect to FIG. 1, the first frame drop rate 138 may be zero (i.e., each input frame is processed). Accordingly, when performing adaptive ANC processing based on the first duty cycle 132, the frame selector 130 may determine that the particular input frame is to be processed. The processor 104 may calculate the (updated) filter parameter information 154 and provide the (updated) filter parameter information 154 to the ANC filter 106.

As another example, when performing adaptive ANC processing based on the second duty cycle 134, the frame selector 130 may determine whether to discard the particular input frame based on the second frame drop rate 140. As described further herein with respect to FIG. 1, the second frame drop rate 140 may indicate to discard fifty percent of input frames (i.e., every other input frame is processed). Accordingly, when performing adaptive ANC processing based on the second duty cycle 134, the frame selector 130 may determine whether a prior input frame was discarded (e.g., whether the frame counter 128 has a frame count of one). As an illustrative example, when the input frame is the third input frame 148, the frame selector 130 may determine whether to discard the third input frame 148 based on whether the frame counter 128 indicates that the prior input frame (i.e., the second input frame 146) was discarded.

As a further example, when performing adaptive ANC processing based on the third duty cycle 136, the frame selector 130 may determine whether to discard the particular input frame based on the third frame drop rate 142. As described further herein with respect to FIG. 1, the third frame drop rate 142 may indicate to discard nine out of ten input frames (i.e., every tenth input frame is processed). Accordingly, when performing adaptive ANC processing based on the third duty cycle 136, the frame selector 130 may determine whether the particular input frame represents the tenth input frame (e.g., whether the frame counter 128 has a frame count of nine). As an illustrative example, when the input frame is the nth input frame 152, the frame selector 130 may determine whether to discard the nth input frame 152 based on whether the frame counter 128 indicates that nine prior input frames have been discarded.

In response to determining that the input frame is to be discarded, the method 500 may include incrementing the counter, as shown at 514. For example, referring to FIG. 1, when the frame selector 130 determines that the particular input frame is to be discarded, the frame selector 130 may increment the frame counter 128. To illustrate, when performing adaptive ANC processing based on the second duty cycle 134 (e.g., discarding every other input frame), the frame selector 130 may increment the frame counter 128 in response to determining that the third input frame 148 is to be discarded. In this case, incrementing the frame counter 128 may provide an indication that the fourth input frame 150 is a next input frame to be processed. As another example, when performing adaptive ANC processing based on the third duty cycle 136 (e.g., processing every tenth input frame), the frame selector 130 may increment the frame counter 128 in response to determining that the nth input frame 152 is to be discarded. In this case, subsequent input frame(s) that follow the nth input frame 152 may be discarded or processed depending on whether the frame counter 128 identifies a particular input frame as the tenth input frame (e.g., when the frame counter 128 has a frame count of nine).

In response to determining that the input frame is not to be discarded, the method 500 includes calculating filter parameters of the ANC filter for the input frame, at 506. For example, referring to FIG. 1, the filter parameter calculator 126 may calculate filter parameters of a particular input frame of the ANC filter 106. The method 500 includes comparing the filter parameters for the input frame to filter parameters calculated for a prior input frame, at 508. For example, referring to FIG. 1, the filter parameters calculated for the particular input frame may be compared to filter parameters calculated for the first input frame 144, the second input frame 146, the third input frame 148, the fourth input frame 150, or another prior input frame depending on the particular input frame received and the current duty cycle. The magnitude of change of filter parameters may be determined based on the comparison. For example, as described further herein with respect to FIG. 1, the magnitude of change (e.g., |dW|) of filter parameters of the ANC filter 106 may be determined based on the "standard" LMS algorithm or based on the "normalized" LMS algorithm, among other alternatives.

As one example, referring to FIG. 1, the second input frame 146 may represent a most recent input frame upon which adaptive ANC processing was performed to determine a set of filter parameters, and the frame counter 128 may indicate that one subsequent input frame (i.e., the third input frame 148) was discarded. In this example, when operating according to the second duty cycle 134, the filter parameters may be calculated for the fourth input frame 150 to be compared to filter parameters previously calculated for the second input frame 146 (that may be stored in a memory). A magnitude of change (e.g., |dW|) of a first set of filter parameters of the fourth input frame 150 of the ANC filter 106 and a second set of filter parameters of the second input frame 146 may be determined based on the "standard" LMS algorithm or based on the "normalized" LMS algorithm, among other alternatives.

As another example, referring to FIG. 1, the first input frame 144 may represent a most recent input frame upon which adaptive ANC processing was performed to determine a set of filter parameters, and the frame counter 128 may indicate that nine input frames following the first input frame 144 were discarded. That is, the nth input frame 152 may represent an input frame that is received after nine input frames following the first input frame 144 have been discarded. In this example, when operating according to the third duty cycle 136, filter parameters may be calculated for the nth input frame 152 to be compared to filter parameters previously calculated for the first input frame 144 (that may be stored in a memory). A magnitude of change (e.g., |dW|) of a first set of filter parameters of the nth input frame 152 of the ANC filter 106 and a second set of filter parameters of the first input frame 144 may be determined based on the "standard" LMS algorithm or based on the "normalized" LMS algorithm, among other alternatives.

The method 500 includes determining whether a magnitude of change of filter parameters of the ANC filter between the input frame and the prior input frame satisfies a threshold, at 510. For example, referring to FIG. 1, the filter parameter calculator 126 may determine whether the magnitude of change of filter parameters of the ANC filter 106 between one input frame (e.g., one of the input frames 146-152) and a prior input frame (e.g., one of the input frames 144-150) satisfies the threshold. As an illustrative example, FIG. 3 illustrates multiple thresholds that may be used to determine a frame drop rate.

As one example, referring to FIG. 1, when performing ANC processing according to the second duty cycle 134, the frame counter 128 may be used to determine whether the second frame drop rate 140 has been satisfied (i.e., a particular number of input frames associated with the second frame drop rate 140 have previously been dropped). As another example, when performing ANC processing according to the third duty cycle 136, the frame counter 128 may be used to determine whether the third frame drop rate 142 has been satisfied (i.e., a particular number of input frames associated with the third frame drop rate 142 have previously been dropped).

In response to determining that the threshold is not satisfied, the method 500 may include incrementing the counter, as shown at 514. For example, referring to FIG. 1, the frame selector 130 may increment the frame counter 128. In response to determining that the threshold is satisfied, the method 500 may include updating the duty cycle of adaptive ANC processing, at 512. The updated duty cycle may include a different number of input frames to discard. For example, referring to FIG. 1, the filter parameter calculator 126 may update the duty cycle to the first duty cycle 132, to the second duty cycle 134, or to the third duty cycle 136. The method 500 may include incrementing the counter, at 514. The method 500 may then return to 502, and another input frame that includes audio data may be received. For example, referring to FIG. 1, the frame counter 128 may be incremented, and another input frame may be received.

FIG. 5 illustrates that, in the event that an input frame is to be processed rather than discarded, a magnitude of change of filter parameters between the input frame and a prior input frame may be used to determine whether to update a duty cycle. The updated duty cycle may indicate a different number of input frames to discard. Thus, in some cases, when the magnitude of change of filter parameters indicates a different rate of acoustic change (see e.g., FIGS. 2 and 3), the number of frames to discard may be updated accordingly.

Figure 6:
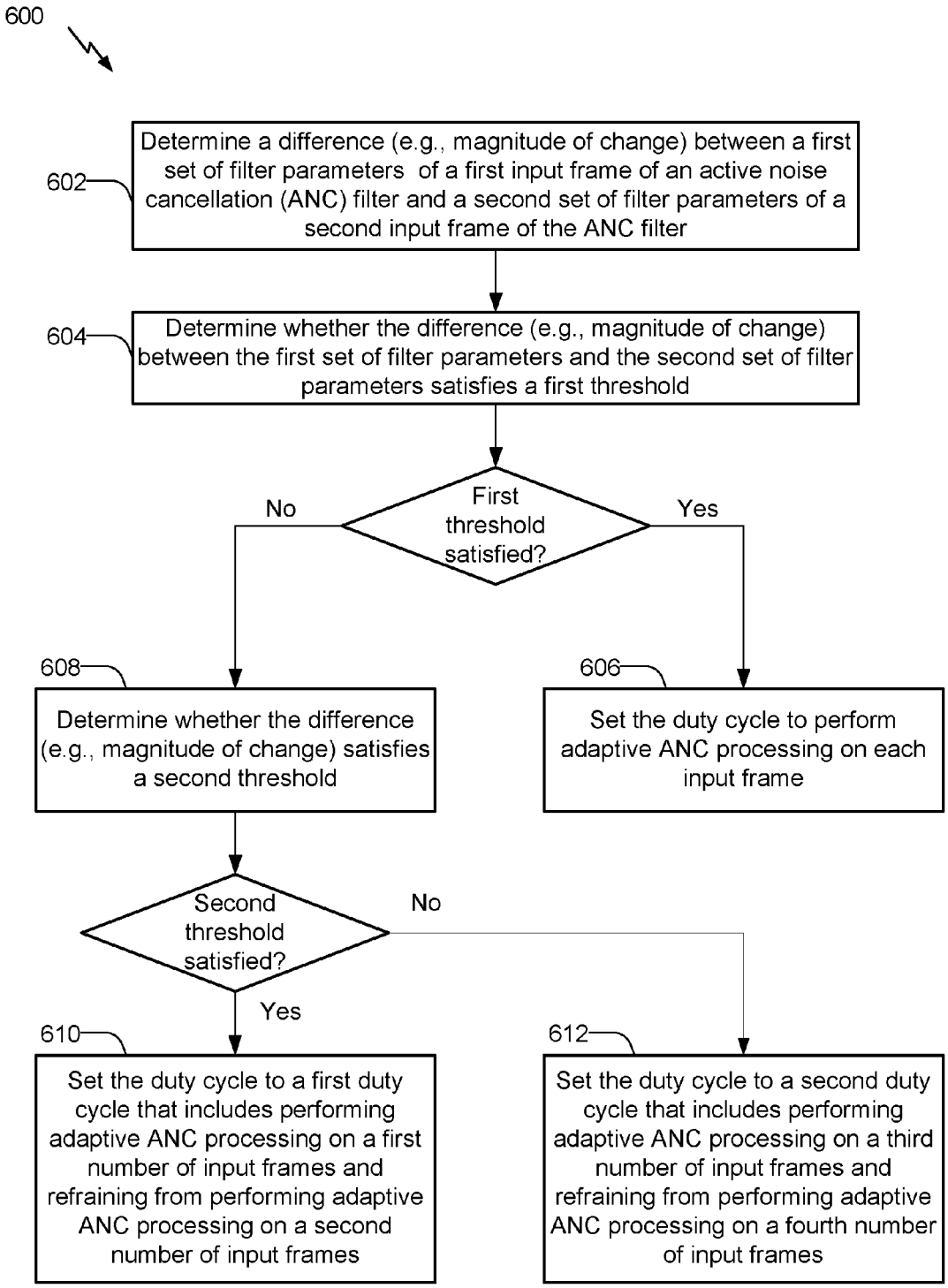
FIG. 6 is a flow diagram that illustrates another example of a method of varying a rate of adaptive ANC processing.

Referring to FIG. 6, a particular example of a method of operation is shown and generally designated 600. FIG. 6 illustrates that a magnitude of change between a set of filter parameters of a first input frame of an ANC filter and a second input frame of the ANC filter may be compared to multiple thresholds in order to determine a particular duty cycle (e.g., frame drop rate) for adaptive ANC processing.

The method 600 includes determining a magnitude of change between a first set of filter parameters of a first input frame of an ANC filter and a second set of filter parameters of a second input frame of the ANC filter, at 602. In a particular implementation, the filter parameters may correspond to filter coefficients of a least-mean-squares (LMS) algorithm. For example, referring to FIG. 1, the filter parameter calculator 126 may calculate filter parameters of the ANC filter 106 based on the input reference signal 110 and the error signal 122 (e.g., for the first input frame 144 and for the second input frame 146). The filter parameter calculator 126 may determine the magnitude of change of filter parameters of the ANC filter 106 based on a comparison of the filter parameters calculated for the first input frame 144 and the filter parameters calculated for the second input frame 146.

The method 600 includes determining whether the magnitude of the change of the first set of filter parameters and the second set of filter parameters satisfies a first threshold, at 604. For example, referring to FIG. 1, the filter parameter calculator 126 may determine whether the magnitude of the change of the filter parameters (e.g., between the first input frame 144 and the second input frame 146) satisfies a first threshold. As an illustrative example, FIG. 3 illustrates multiple thresholds that may be used to determine a frame drop rate.

In response to determining that the first threshold is satisfied, the method 600 includes setting the duty cycle to perform adaptive ANC processing on each input frame, at 606. For example, referring to FIG. 1, the filter parameter calculator 126 may set the duty cycle to the first duty cycle 132. As described further with respect to FIG. 1, the first frame drop rate 138 associated with the first duty cycle 132 may correspond to a frame drop rate of zero. That is, setting the duty cycle to the first duty cycle 132 may be used for relatively large acoustic changes (see e.g., the first duty cycle 202 of FIG. 2) in order to increase the rate of adaptation.

In response to determining that the first threshold is not satisfied, the method 600 includes determining whether the magnitude of change of the filter parameters satisfies a second threshold, at 608. In response to determining that the second threshold is satisfied, the method 600 includes setting the duty cycle to a first duty cycle, at 610. The first duty cycle includes performing adaptive ANC processing on a first number of input frames and refraining from performing adaptive ANC processing on a second number of input frames. For example, referring to FIG. 1, the filter parameter calculator 126 may set the duty cycle to the second duty cycle 134 associated with the second frame drop rate 140. The filter parameter calculator 126 may refrain from performing adaptive ANC processing on a particular number of input frames based on the second frame drop rate 140. To illustrate, the second duty cycle 134 may be used when the magnitude of change of parameters corresponds to relatively moderate acoustic changes (see e.g., the second duty cycle 204 of FIG. 2).

When the second threshold is not satisfied, the method 600 may include setting the duty cycle to a second duty cycle, at 612. The second duty cycle includes performing adaptive ANC processing on a third number of input frames and refraining from performing adaptive ANC processing on a fourth number of input frames. For example, referring to FIG. 1, the filter parameter calculator 126 may set the duty cycle to the third duty cycle 136 associated with the third frame drop rate 142. The filter parameter calculator 126 may refrain from performing adaptive ANC processing on a particular number of input frames based on the third frame drop rate 142. To illustrate, the third duty cycle 136 may be used when the magnitude of change of parameters corresponds to relatively small acoustic changes (see e.g., the third duty cycle 206 of FIG. 2).

Thus, FIG. 6 illustrates that a magnitude of change of filter parameters of input frames of an ANC filter may be compared to multiple thresholds in order to determine a particular duty cycle (e.g., frame drop rate) for adaptive ANC processing. When the magnitude of change of filter parameters indicates a different rate of acoustic change (see e.g., FIGS. 2 and 3), the number of frames to discard may be updated accordingly.

Figure 7:
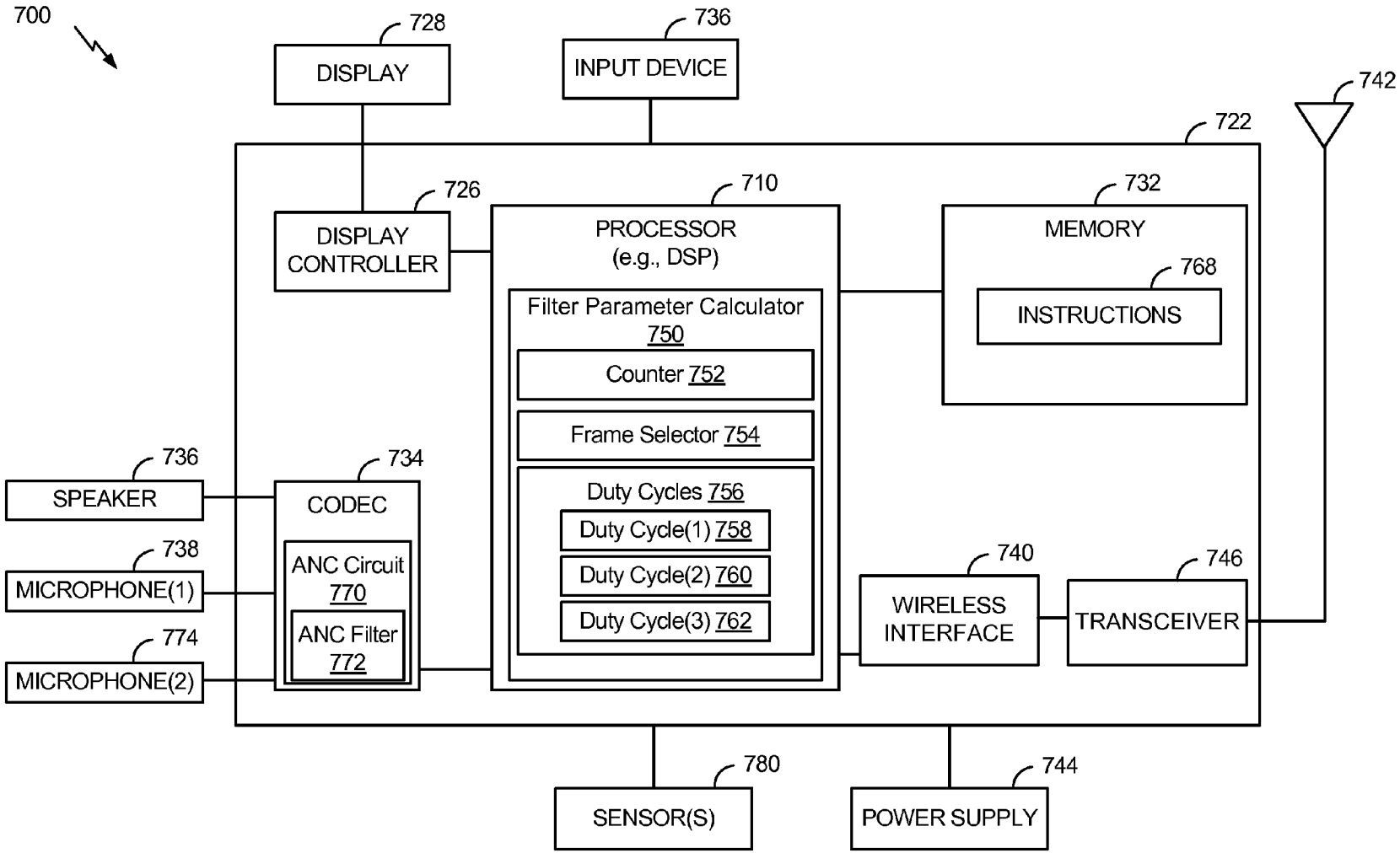
FIG. 7 is a diagram of an electronic device (e.g., a wireless device) that is operable to support various implementations of one or more methods, systems, apparatuses, and/or computer-readable media disclosed herein.

Referring to FIG. 7, a particular illustrative implementation of an electronic device (e.g., a wireless communication device) is depicted and generally designated 700. The device 700 includes a processor 710, such as a digital signal processor, coupled to a memory 732. In an illustrative example, the device 700, or components thereof, may correspond to the variable rate adaptive ANC system 100 of FIG. 1, or components thereof. For example, the processor 710 of FIG. 7 may correspond to the processor 104 of FIG. 1. Further, in the example of FIG. 7, the processor 710 includes a filter parameter calculator 750, a counter 752, a frame selector 754, and a plurality of duty cycles 756 (e.g., a first duty cycle 758, a second duty cycle 760, and a third duty cycle 762). The filter parameter calculator 750 may correspond to the filter parameter calculator 126 of FIG. 1, the counter 752 may correspond to the frame counter 128 of FIG. 1, and the frame selector 754 may correspond to the frame selector 130 of FIG. 1. Further, the duty cycles 756 illustrated in FIG. 7 may correspond to the duty cycles 132-136 of FIG. 1. However, it will be appreciated that an alternative number of duty cycles may be used.

The processor 710 may be configured to execute software (e.g., a program of one or more instructions 768) stored in the memory 732. FIG. 7 further illustrates a wireless interface 740 (e.g., an Institute of Electrical and Electronics Engineers (IEEE) 802.11 compliant interface) that may be configured to operate in accordance with one or more wireless communication standards, including one or more IEEE 802.11 standards. In a particular implementation, the processor 710 may be configured to perform one or more operations or methods described with reference to FIGS. 1-6. For example, the processor 710 may be configured to determine a magnitude of change of filter parameters of an ANC filter (e.g., the ANC filter 106 of FIG. 1) between two input frames and to set a duty cycle of adaptive ANC processing based on the magnitude of change of the filter parameters.

The wireless interface 740 may be coupled to the processor 710 and to an antenna 742. For example, the wireless interface 740 may be coupled to the antenna 742 via a transceiver 746, such that wireless signals received via the antenna 742 may be provided to the processor 710.

A coder/decoder (CODEC) 734 can also be coupled to the processor 710. A speaker 736 and one or more microphones can be coupled to the CODEC 734. In the particular implementation illustrated in FIG. 7, a first microphone 738 and a second microphone 774 is coupled to the CODEC 734. For example, the first microphone 738 may correspond to the reference microphone 108 of FIG. 1, and the second microphone 774 may correspond to the error microphone 124 of FIG. 1. The first microphone 738 may be configured to provide an input reference signal (e.g., the input reference signal 110 of FIG. 1) to the ANC filter 772 and to the processor 710. The second microphone 774 may be configured to provide an error signal 122 (e.g., the error signal 122 of FIG. 1) to the ANC filter 772 and to the processor 710. FIG. 7 further illustrates a particular example in which the CODEC 734 includes an ANC circuit 770 that includes an ANC filter 772. For example, the ANC circuit 770 may correspond to the ANC circuit 102 of FIG. 1, and the ANC filter 772 may correspond to the ANC filter 106 of FIG. 1. The ANC filter 772 may be configured to perform active noise cancellation on particular input frames based on an ANC duty cycle (e.g., one of the duty cycles 756 in FIG. 7). The processor 710 may consume power at a first power consumption rate when a duty cycle of adaptive ANC processing associated with the ANC filter 772 has a first value and may consume power at a second power consumption rate when the duty cycle has a second value.

A display controller 726 can be coupled to the processor 710 and to a display device 728. In some cases, the display device 728 may include a touchscreen display. In a particular implementation, the processor 710, the display controller 726, the memory 732, the CODEC 734, and the wireless interface 740 are included in a system-in-package or system-on-chip device 722. In a particular implementation, an input device 730 and a power supply 744 are coupled to the system-on-chip device 722. Moreover, in a particular implementation, as illustrated in FIG. 7, the display device 728, the input device 730, the speaker 736, the microphones 738 and 774, the antenna 742, and the power supply 744 are external to the system-on-chip device 722. However, each of the display device 728, the input device 730, the speaker 736, the microphones 738 and 774, the antenna 742, and the power supply 744 can be coupled to one or more components of the system-on-chip device 722, such as one or more interfaces or controllers. FIG. 7 further illustrates a particular implementation in which the device 700 includes one or more sensors 780 that may provide sensor information to the device 700. To illustrate, the sensor(s) 780 may include a motion sensor (e.g., an accelerometer), a pressure sensor (e.g., associated with the display device 728 in the case of a touchscreen display), or a touch sensor (e.g., associated with the display device 728 in the case of a touchscreen display), among other alternatives. In a particular implementation, the device 700 may include at least one of a communications device, a music player, a video player, an entertainment unit, a navigation device, a personal digital assistant (PDA), a mobile device, a computer, a decoder, or a set top box.

In conjunction with the described implementations, an apparatus includes means for determining a magnitude of change between a first set of filter parameters of an ANC filter and a second set of filter parameters of a second input frame of the ANC filter. The apparatus also includes means for selectively modifying a duty cycle of adaptive ANC processing associated with the ANC filter based on the magnitude of change between the first set of filter parameters and the second set of filter parameters. The apparatus may include means for performing the adaptive ANC processing. The apparatus may include means for determining whether the magnitude of change between the first set of filter parameters and the second set of filter parameters satisfies a threshold, means for setting the duty cycle to a particular duty cycle based on whether the magnitude of change between the first set of filter parameters and the second set of filter parameters satisfies the threshold, and means for determining a particular number of input frames to be provided for adaptive ANC processing based on the particular duty cycle.

For example, the means for determining the magnitude of change of the filter parameters may include the processor 710 programmed to execute the instructions 768, one or more other devices, circuits, modules, or any combination thereof. As one example, referring to the method 400 of FIG. 4, the means for determining the magnitude of change may perform part 402 of the method 400. As another example, referring to the method 600 of FIG. 6, the means for determining the magnitude of change may perform part 602 of the method 600.

The means for selectively modifying the duty cycle may include the processor 710 programmed to execute the instructions 768, one or more other devices, circuits, modules, or any combination thereof. To illustrate, referring to the method 400 of FIG. 4, the means for selectively modifying the duty cycle may perform part 404 of the method 400.

Further, the means for determining whether the magnitude of change of the filter parameters satisfies the threshold may include the processor 710 programmed to execute the instructions 768, one or more other devices, circuits, modules, or any combination thereof. As one example, referring to the method 500 of FIG. 5, the means for determining whether the magnitude of change satisfies the threshold may perform part 510 of the method 500. As another example, referring to the method 600 of FIG. 6, the means for determining whether the magnitude of change satisfies the threshold may perform parts 604 and 608 of the method 600.

Further, the means for setting the duty cycle to a particular duty cycle may include the processor 710 programmed to execute the instructions 768, one or more other devices, circuits, modules, or any combination thereof. Further, the means for determining the particular number of input frames to be provided for adaptive ANC processing may include the processor 710 programmed to execute the instructions 768, one or more other devices, circuits, modules, or any combination thereof. As one example, referring to the method 500 of FIG. 5, the means for setting the duty cycle and the means for determining the particular number of input frames may perform part 512 of the method 500. As another example, referring to the method 600 of FIG. 6, the means for setting the duty cycle and the means for determining the particular number of input frames may perform parts 606, 610, and 612 of the method 600.

Those of skill in the art would further appreciate that the various illustrative logical blocks, configurations, modules, circuits, and algorithm steps described in connection with the implementations disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the examples disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient (e.g., non-transitory) storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description is provided to enable a person skilled in the art to make or use the disclosed implementations. Various modifications to these examples will be readily apparent to those skilled in the art, and the principles defined herein may be applied to other implementations without departing from the scope of the disclosure. Thus, the present disclosure is not intended to be limited to the examples shown herein but is to be accorded the widest scope possible consistent with the principles and novel features as defined by the following claims.

What is claimed is:

1. A method of audio signal processing, the method comprising:

determining a difference between a first set of filter parameters of a first input frame of an active noise cancellation (ANC) filter and a second set of filter parameters of a second input frame of the ANC filter; and selectively modifying a duty cycle of adaptive ANC processing associated with the ANC filter based on the difference between the first set of filter parameters and the second set of filter parameters.

2. The method of claim 1, wherein the duty cycle includes a first duty cycle, wherein the first duty cycle includes performing adaptive ANC processing on a first subset of input frames of a plurality of input frames and refraining from performing adaptive ANC processing on a second subset of input frames of the plurality of input frames.

3. The method of claim 2, further comprising refraining from sending filter parameter information to adjust the ANC filter for the second subset of input frames of the plurality of input frames.

4. The method of claim 1, further comprising:

calculating a first set of filter coefficients of an algorithm associated with the ANC filter by processing the first input frame;

calculating a second set of filter coefficients of the algorithm associated with the ANC filter by processing the second input frame; and comparing the first set of filter coefficients to the second set of filter coefficients, wherein the difference between the first set of filter parameters and the second set of filter parameters is determined based on the comparison.

5. The method of claim 4, wherein the algorithm of the ANC filter includes a least-mean-squares (LMS) algorithm.

6. The method of claim 1, further comprising:

receiving a third input frame of the ANC filter;

determining, based on a counter and the duty cycle, whether the third input frame is to be discarded, wherein the duty cycle indicates a number of input frames to discard;

in response to determining that the third input frame is to be discarded, incrementing the counter; and in response to determining that adaptive ANC processing is to be performed for the third input frame:

calculating a third set of filter parameters of the third input frame of the ANC filter;

comparing the third set of filter parameters to another set of filter parameters calculated for a previous input frame of the ANC filter, wherein a difference between the third set of filter parameters and the other set of filter parameters is determined based on the comparison;

updating the number of input frames to discard based on the difference between the third set of filter parameters and the other set of filter parameters; and incrementing the counter.

7. The method of claim 1, further comprising:

determining whether the difference between the first set of filter parameters and the second set of filter parameters satisfies a first threshold; and in response to determining that the difference between the first set of filter parameters and the second set of filter parameters does not satisfy the first threshold, setting the duty cycle to a first duty cycle that includes performing adaptive ANC processing on a first number of input frames and refraining from performing adaptive ANC processing on a second number of input frames.

8. The method of claim 7, further comprising:

determining whether the difference between the first set of filter parameters and the second set of filter parameters satisfies a second threshold, wherein the second threshold represents a reduced difference with respect to the first threshold; and in response to determining that the difference between the first set of filter parameters and the second set of filter parameters does not satisfy the second threshold, setting the duty cycle to a second duty cycle that includes performing adaptive ANC processing on a third number of input frames and refraining from performing adaptive ANC processing on a fourth number of input frames, wherein the third number of input frames is less than the first number of input frames, and wherein the fourth number of input frames is more than the second number of input frames.

9. The method of claim 7, further comprising setting the duty cycle to perform adaptive ANC processing on each input frame in response to determining that the difference satisfies the first threshold.

10. The method of claim 1, wherein selectively modifying the duty cycle includes storing a value in memory that indicates a number of input frames to discard.

11. The method of claim 1, further comprising receiving information from a sensor, wherein the difference is determined based on the information received from the sensor.

12. The method of claim 11, wherein the sensor includes a motion sensor.

13. The method of claim 12, wherein the motion sensor includes an accelerometer disposed within a headset device or a handset device.

14. The method of claim 11, wherein the sensor includes a pressure sensor associated with a touchscreen display of a handset device.

15. The method of claim 11, wherein the sensor includes a touch sensor associated with a touchscreen display of a handset device.

16. An apparatus comprising:

a processor; and a memory coupled to the processor, wherein the memory stores instructions that are executable by the processor to perform operations comprising:

determining a difference between a first set of filter parameters of a first input frame of an active noise cancellation (ANC) filter and a second set of filter parameters of a second input frame of the ANC filter; and selectively modifying a duty cycle of adaptive ANC processing associated with the ANC filter based on the difference between the first set of filter parameters and the second set of filter parameters.

17. The apparatus of claim 16, the operations further comprising:

determining whether the difference between the first set of filter parameters and the second set of filter parameters satisfies a first threshold; and in response to determining that the difference between the first set of filter parameters and the second set of filter parameters does not satisfy the first threshold, setting the duty cycle to a first duty cycle that includes:

providing a first number of input frames to the processor for performing adaptive ANC processing; and refraining from providing a second number of input frames to the processor.

18. The apparatus of claim 17, the operations further comprising:

determining whether the difference between the first set of filter parameters and the second set of filter parameters satisfies a second threshold, wherein the second threshold represents a reduced difference with respect to the first threshold; and in response to determining that the difference between the first set of filter parameters and the second set of filter parameters does not satisfy the second threshold, setting the duty cycle to a second duty cycle that includes:

providing a third number of input frames to the processor for performing adaptive ANC processing; and refraining from providing a fourth number of input frames to the processor, wherein the third number of input frames is less than the first number of input frames, and wherein the fourth number of input frames is more than the second number of input frames.

19. The apparatus of claim 17, the operations further comprising setting the duty cycle to provide each input frame to the processor for adaptive ANC processing in response to determining that the difference between the first set of filter parameters and the second set of filter parameters satisfies the first threshold.

20. The apparatus of claim 16, wherein the difference between the first set of filter parameters and the second set of filter parameters is determined based at least in part on motion data captured by a motion sensor.

21. The apparatus of claim 20, further comprising the motion sensor.

22. The apparatus of claim 20, wherein the motion sensor includes an accelerometer disposed within a headset device.

23. The apparatus of claim 16, further comprising a touchscreen display, wherein the difference between the first set of filter parameters and the second set of filter parameters is determined based at least in part on touch data or pressure data captured via the touchscreen display.

24. A non-transitory computer-readable medium comprising instructions that, when executed by a processor, cause the processor to:

determine a difference between a first set of filter parameters of a first input frame of an active noise cancellation (ANC) filter and a second set of filter parameters of a second input frame of the ANC filter; and selectively modify a duty cycle of adaptive ANC processing associated with the ANC filter based on the difference between the first set of filter parameters and the second set of filter parameters.

25. The non-transitory computer-readable medium of claim 24, the operations further comprising:

determining whether the difference satisfies a first threshold; and in response to determining that the difference does not satisfy the first threshold, setting the duty cycle to a first duty cycle that includes:

providing a first number of input frames to a processor for performing adaptive ANC processing; and refraining from providing a second number of input frames to the processor.

26. The non-transitory computer-readable medium of claim 25, the operations further comprising:

determining whether the difference satisfies a second threshold, wherein the second threshold represents a reduced magnitude of change with respect to the first threshold; and in response to determining that the difference does not satisfy the second threshold, setting the duty cycle to a second duty cycle that includes:

providing a third number of input frames to the processor for performing adaptive ANC processing; and refraining from providing a fourth number of input frames to the processor, wherein the third number of input frames is less than the first number of input frames, and wherein the fourth number of input frames is more than the second number of input frames.

27. The non-transitory computer-readable medium of claim 25, the operations further comprising setting the duty cycle to provide each input frame to the processor for adaptive ANC processing in response to determining that the difference satisfies the first threshold.

28. An apparatus comprising:

means for determining a difference between a first set of filter parameters of a first input frame of an active noise cancellation (ANC) filter and a second set of filter parameters of a second input frame of the ANC filter; and means for selectively modifying a duty cycle of adaptive ANC processing associated with the ANC filter based on the difference between the first set of filter parameters and the second set of filter parameters.

29. The apparatus of claim 28, further comprising means for performing the adaptive ANC processing.

30. The apparatus of claim 28, further comprising:

means for determining whether the difference satisfies a threshold;

means for setting the duty cycle to a particular duty cycle based on whether the difference satisfies the threshold; and means for determining a particular number of input frames to be provided for adaptive ANC processing based on the particular duty cycle.

* * * * *